US008998056B2

(12) United States Patent
Huang et al.

(10) Patent No.: US 8,998,056 B2
(45) Date of Patent: Apr. 7, 2015

(54) NAIL GUN STRUCTURE

(71) Applicants: Chun-Ming Huang, Taichung (TW); Tung-Sung Yeh, Taichung (TW)

(72) Inventors: Chun-Ming Huang, Taichung (TW); Tung-Sung Yeh, Taichung (TW)

(73) Assignee: Apach Industrial Co., Ltd., Taichung ( * ) Notice: Subject to any disclaimer, the term of this patent is extended or adjusted under 35 U.S.C. 154(b) by 261 days.

(21) Appl. No.: 13/754,784

(22) Filed: Jan. 30, 2013

(65) Prior Publication Data

US 2014/0209657 A1 Jul. 31, 2014

(51) Int. Cl.

| | |
|---|---|
| ***B27F 7/09*** | (2006.01) |
| ***B25C 1/04*** | (2006.01) |
| ***B25C 7/00*** | (2006.01) |

(52) U.S. Cl.

CPC . *B25C 1/047* (2013.01); *B27F 7/09* (2013.01); *B25C 7/00* (2013.01)

(58) Field of Classification Search

CPC ..... B25C 5/06; B25C 5/10; B25C 5/13; B27F 7/02; B27F 7/09

USPC ..... 227/19, 28, 29, 8, 37, 124, 147, 152, 227/154, 155

See application file for complete search history.

(56) References Cited

U.S. PATENT DOCUMENTS

| | | | | | |
|---|---|---|---|---|---|
| 2,687,522 | A * | 8/1954 | Juilfs | ..... | 227/124 |
| 3,397,828 | A * | 8/1968 | Volkmann | ..... | 227/130 |
| 3,734,378 | A * | 5/1973 | Rice et al. | ..... | 227/124 |
| 3,735,908 | A * | 5/1973 | Kinney et al. | ..... | 227/67 |
| 3,900,114 | A * | 8/1975 | Inoue et al. | ..... | 212/83 |
| 3,900,144 | A * | 8/1975 | Hamilton | ..... | 227/155 |
| 2010/0012700 | A1 * | 1/2010 | Perron et al. | ..... | 227/8 |
| 2014/0076954 | A1 * | 3/2014 | Miller et al. | ..... | 227/155 |

* cited by examiner

*Primary Examiner* — William Gilbert

(57) ABSTRACT

A nail gun structure includes a gun body, a clamp set and a pneumatic driving set. The gun body has a trigger for shooting a nail. The clamp set is assembled with the gun body. The clamp set has a driven base and a clamp base. The clamp base pivots relative to the driven base. A stacked board is positioned on the clamp base. The pneumatic driving set is disposed between the gun body and the clamp set. The pneumatic driving set communicates with an air pressure source. The trigger moves along with the pneumatic driving set. Under this arrangement, when a user pulls the trigger, the pneumatic driving set drives the clamp base to pivot, so that the stacked boards are clamped between the clamp base and the driven base; thereafter, the nail is shot and nailed on the stacked board.

7 Claims, 12 Drawing Sheets

NAIL GUN STRUCTURE

BACKGROUND OF THE INVENTION

1. Field of the Invention

The present invention relates to a pneumatic nail gun, and more particularly to the pneumatic nail gun which clamps and nails the stacked boards.

2. Description of Related Art

Pallets, constructed with wooden slats, are essential among the warehousing and storage industries. In order to allow the pallets being capable of loading heavy goods, the pallet manufacturer often increases the loading capacity of the wooden slats by stacking, aligning and fixing two pieces of wooden slats together so as to form a stacked wooden slat. Therefore, the pallets made with the stacked wooden slats can support heavy goods stably.

A conventional nail gun is used to fix two pieces of wooden slats together. When fixing the wooden slats via the conventional nail gun, a positioning tool, such as a C-clamp, is necessary for positioning and holding the wooden slats to prevent the wooden slats from sliding or misaligning because of the impulse force triggered by the conventional nail gun. Therefore, the wooden slats remain stacked and aligned within the positioning tool when a user triggers the conventional nail gun. After the wooden slats are fixed together, the positioning tool is taken off from the stacked wooden slat and clamped onto the next two pieces of wooden slats so as to start the next fixing procedure. Although the conventional nail gun and the positioning tool can fix the wooden slats together, the need of the positioning tool makes the fixing procedure complicated and time-consuming.

Thereby, the present invention has arisen to mitigate and/or obviate the disadvantages of the conventional nail gun.

SUMMARY OF THE INVENTION

The main objective of the present invention is to provide an improved nail gun structure.

To achieve the objective, a nail gun structure comprises a gun body, a clamp set and a pneumatic driving set, the clamp set assembled with the gun body, the clamp set having a driven base and a clamp base defined thereon, the clamp base pivoting relative to the driven base so as to move toward or away from the driven base, at least two boards stacked and aligned to form a stacked board, the stacked board positioned on the clamp base and clamped between the clamp base and the driven base when the clamp base pivots relative to the driven base, the stacked board corresponding to an outlet of the gun head for shooting the nail, the pneumatic driving set disposed between the gun body and the clamp set, the pneumatic driving set communicating with an air pressure source, the pneumatic driving set moved along with a trigger of the gun body. Wherein, the clamp set further has a fixed plate and a connecting rod, the fixed plate has a first assembling part and a second assembling part, the first assembling part is assembled on the gun body, one end of the second assembling part is connected to one end of the first assembling part, one angle is defined between the first assembling part and the second assembling part, another end of the second assembling part is disposed on one end of the driven base, one end of the connecting rod is assembled with one end of the handle, another end of the connecting rod is assembled with another end of the driven base; the clamp set further has an extension part, one end of the extension part is connected to another end of the first assembling part, another angle in defined between the extension part and the first assembling part, a handle part is disposed on the extension part; the pneumatic driving set further has a pneumatic valve, a first connecting valve, a second connecting valve, an adjusting valve and a driving valve, the pneumatic valve is disposed on the fixed plate, the first connecting valve is defined between the gun body and the air pressure source, the first connecting valve communicates with the gun body and the air pressure source, the first connecting valve communicates with the pneumatic valve via a first air tube, the second connecting valve is defined between the pneumatic valve and the adjusting valve, the second connecting valve communicates with the gun body via a second air tube, the adjusting valve communicates with the gun body via a third air tube, the driving valve is disposed on the driven base, the driving valve communicates with the pneumatic valve via a fourth air tube, so that the driving valve drives the clamp base pivoting relative to the driven base; the driven base further has a receiving part and a first clamp segment which is connected to the receiving part, the receiving part has two plate parts and an opening part defined thereon, a distance is defined between the two plate parts, the opening part is opened between the two plate parts, the clamp base further has a pivoting segment pivotally assembled in the opening part of the driven base, a driven segment is disposed on one end of the pivoting segment, a second clamp segment is disposed on another end of the pivoting segment, an angle is defined between the driven segment and the second clamp segment, the driven segment is assembled with the driving valve and received in the receiving part, the driving valve is used to drive the driven segment, the second clamp segment is extended toward the gun head and parallel to the first clamp segment; a spring is received between the driven segment and the receiving part; a strike plate is disposed on the second clamp segment, the strike plate corresponds to the outlet of the gun head for shooting the nail; and a secure set is assembled to the gun head so as to so secure the trigger.

Under this arrangement, when a user pulls the trigger, the pneumatic driving set is moved simultaneously so as to push the clamp base pivoting relative to the driven base, so that the stacked board is positioned and clamped between the clamp base and the driven base; and then, the nail is shot from the gun head and nailed on the stacked board; lastly, the clamp base pivotally moves away from the driven base when the trigger is released by the user.

Further benefits and advantages of the present invention will become apparent after a careful reading of the detailed description with appropriate reference to the accompanying drawings.

DETAILED DESCRIPTION OF THE INVENTION

Figure 1:
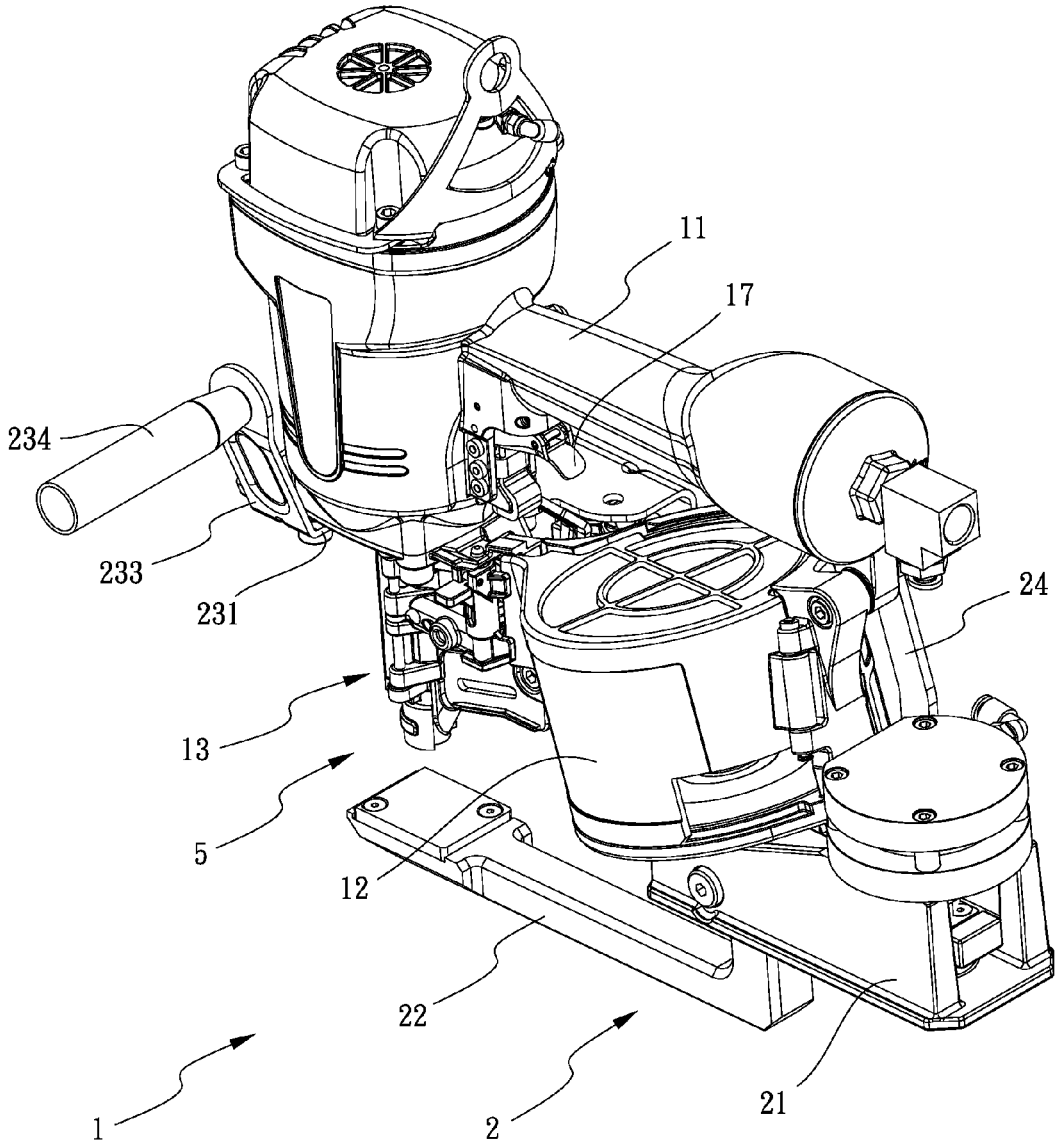
FIG. 1 is a perspective view of a nail gun structure in accordance with the present invention.
Figure 2:
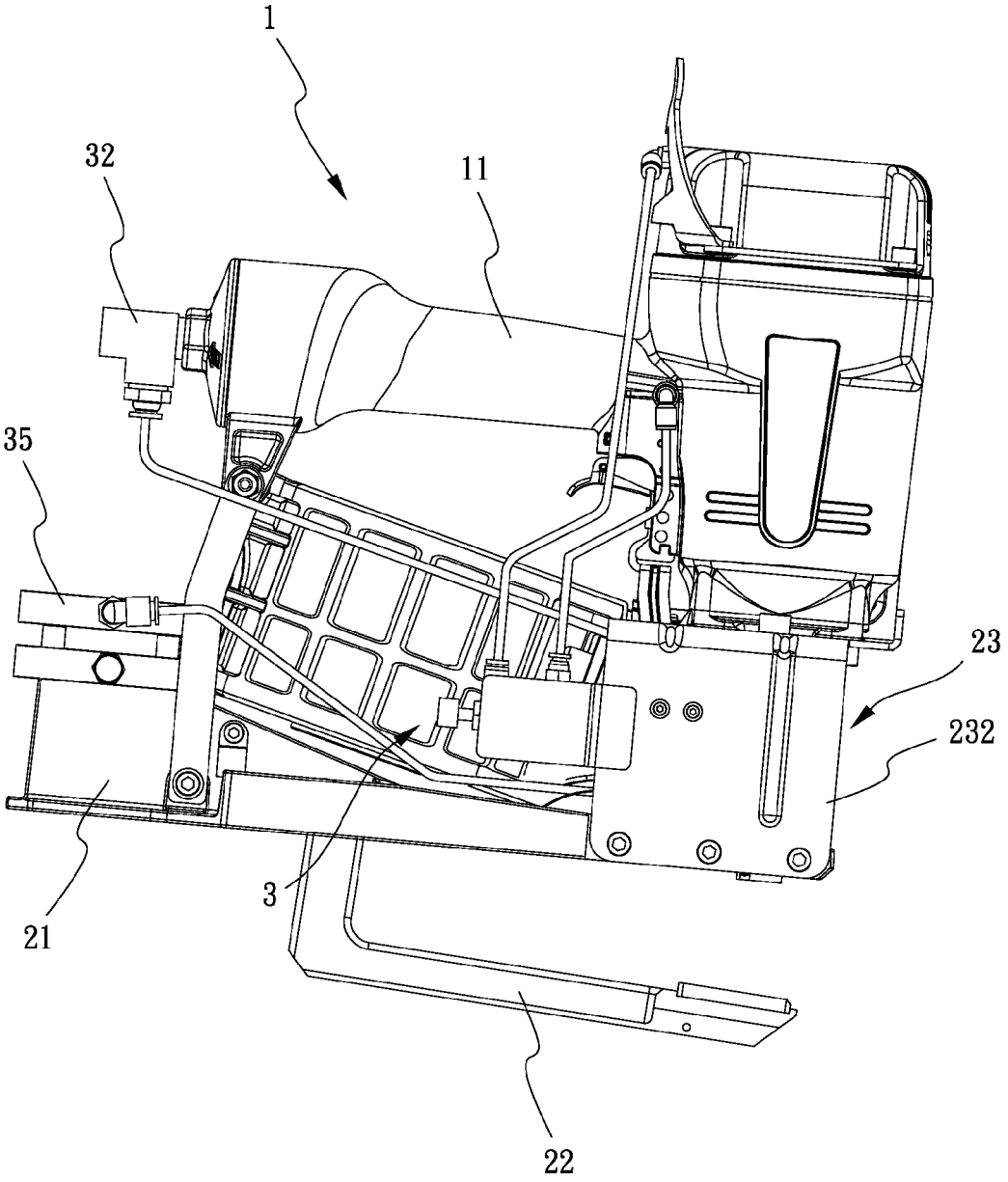
FIG. 2 is a side view of the present invention.
Figure 3:
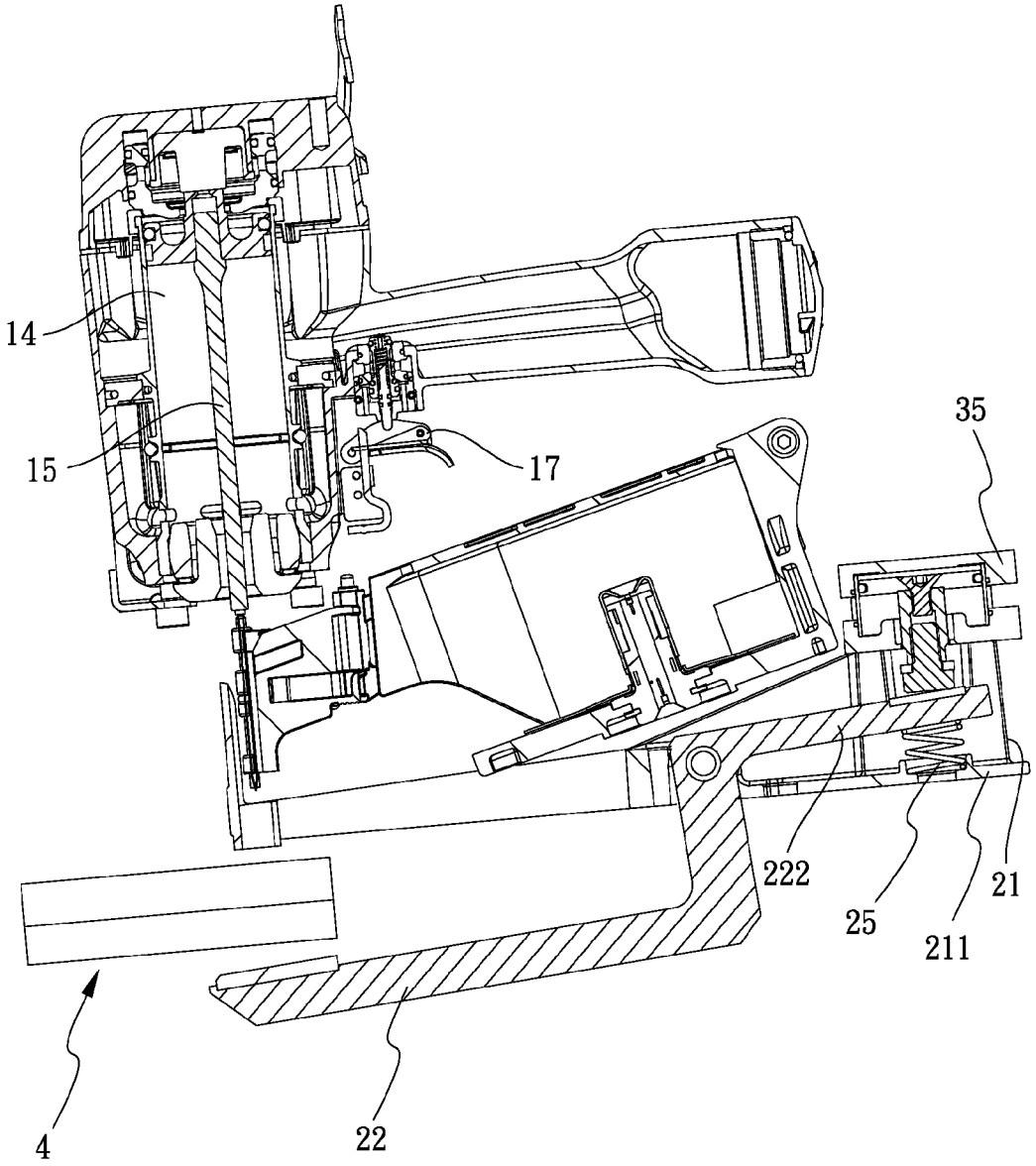
FIGS. 3-6 are side views for showing the present invention shoots a nail into a stacked board.
Figure 4:
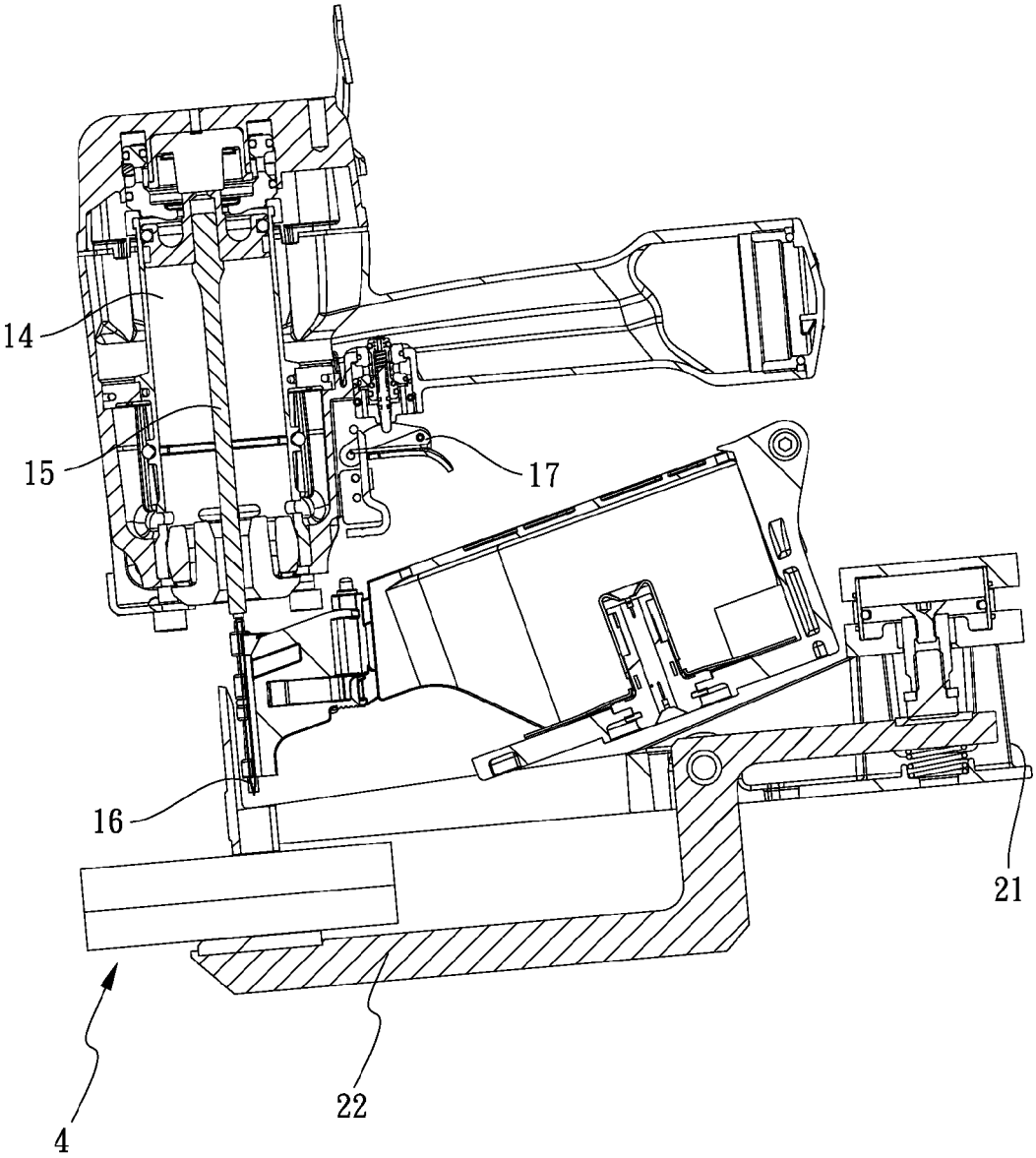
Figure 5:
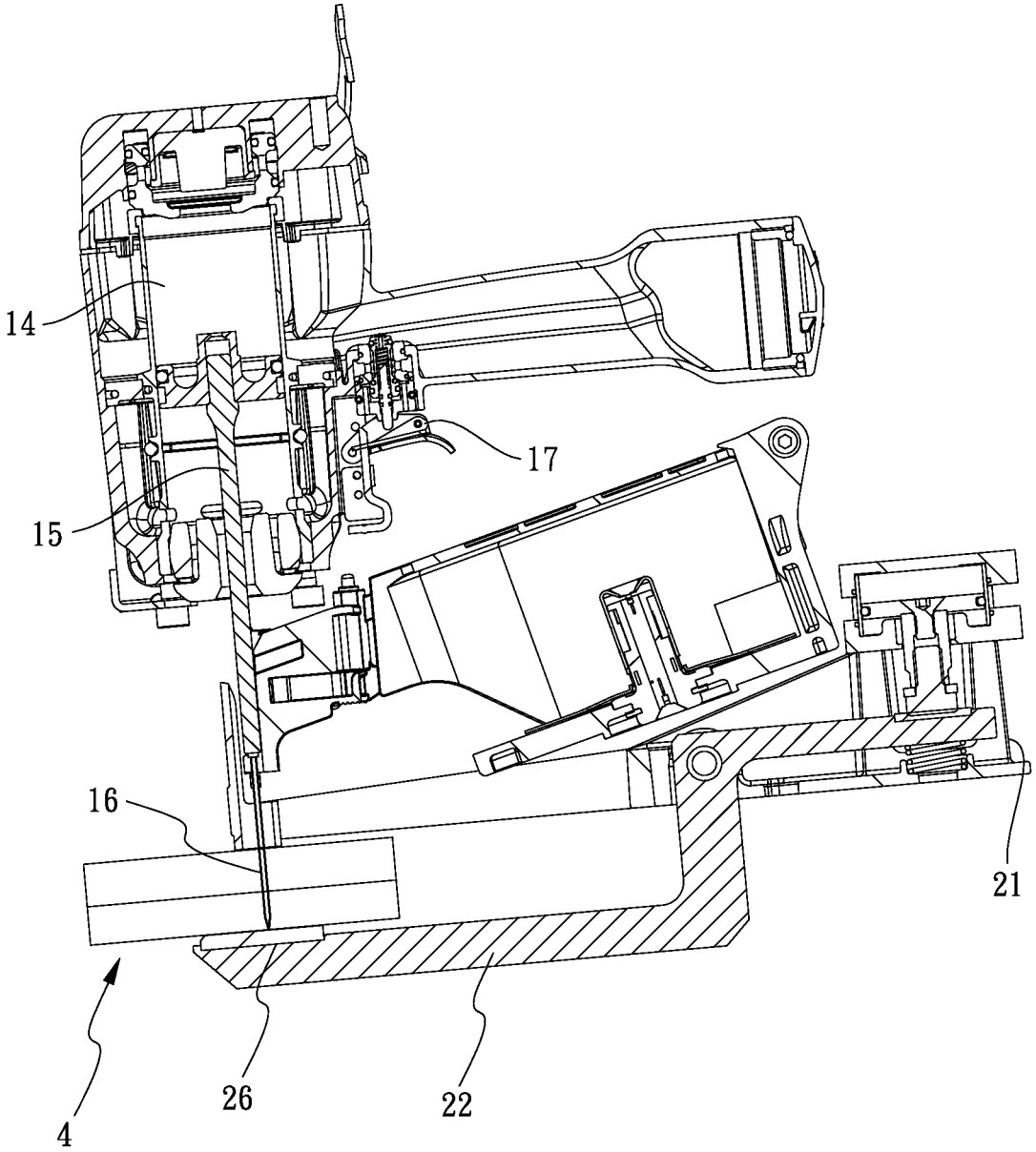
Figure 6:
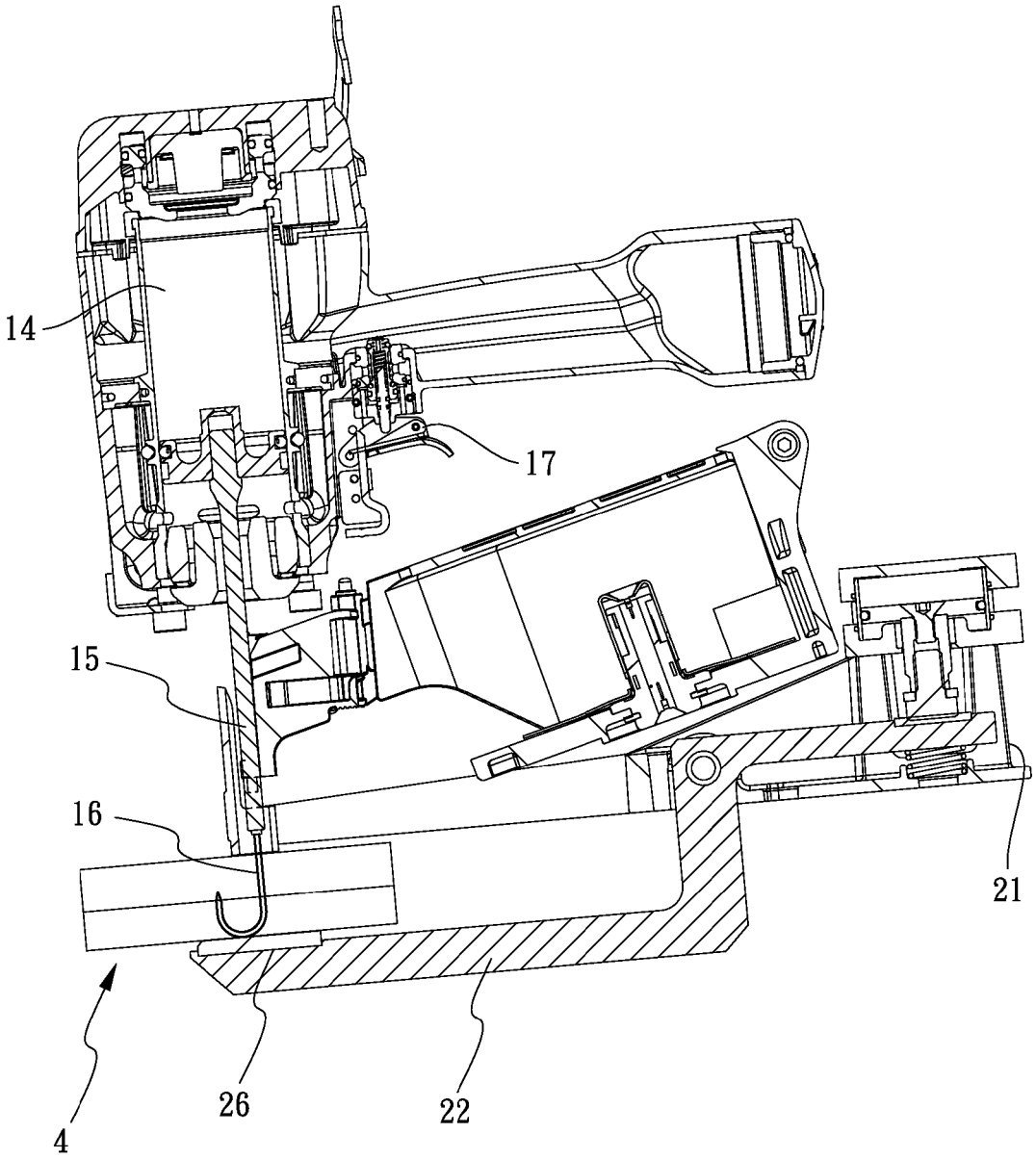

Referring to FIGS. 1-6, a nail gun structure comprises a gun body 1, a clamp set 2 and a pneumatic driving set 3. The gun body 1 has a handle 11 and a trigger 17 defined thereon. The trigger 17 is used to control the shooting of a nail 16. A nail cartridge 12 is assembled on the gun body 1. A strip of nails (not numbered) is defined in the nail cartridge 12. A gun head 13 is defined at one end of the gun body 1. An air chamber 14 is defined in the gun body 1. The air chamber 14 allows an amount of compressed air to flow through, so that the nail 16 is pushed by the compressed air and shot from the gun head 13. The clamp set 2 is assembled with the gun body 1. The clamp set 2 has a driven base 21 and a clamp base 22 defined thereon. The clamp base 22 pivots relative to the driven base 21 so as to move toward or away from the driven base 21. At least two boards (not numbered) are stacked and aligned to form a stacked board 4. The stacked board 4 is positioned on the clamp base 22 and is clamped between the clamp base 22 and the driven base 21 when the clamp base 22 pivots relative to the driven base 21. The stacked board 4 corresponds to an outlet (not numbered) of the gun head 13 for shooting the nail 16. The pneumatic driving set 3 is disposed between the gun body 1 and the clamp set 2. The pneumatic driving set 3 communicates with an air pressure source (not shown). The pneumatic driving set 3 is moved along with the trigger 17 of the gun body 1. Under this arrangement, when a user pulls the trigger 17, the pneumatic driving set 3 is moved simultaneously so as to push the clamp base 22 pivoting relative to the driven base 21, so that the stacked board 4 is positioned and clamped between the clamp base 22 and the driven base 21; and then, the nail 16 is shot from the gun head 13 and nailed on the stacked board 4; lastly, the clamp base 22 pivotally moves away from the driven base 21 when the trigger 17 is released by the user.

The characteristics of the present invention are detailed as following.

The clamp set 2 further has a fixed plate 23 and a connecting rod 24. The fixed plate 23 has a first assembling part 231, a second assembling part 232 and an extension part 233. The first assembling part 231 is assembled on the gun body 1. One end of the second assembling part 232 is connected to one end of the first assembling part 231. One angle is defined between the first assembling part 231 and the second assembling part 232. Another end of the second assembling part 232 is disposed on one end of the driven base 21. One end of the connecting rod 24 is assembled with one end of the handle 11. Another end of the connecting rod 24 is assembled with another end of the driven base 21. One end of the extension part 233 is connected to another end of the first assembling part 231. Another angle in defined between the extension part 233 and the first assembling part 231. A handle part 234 is disposed on the extension part 233. Therefore, the user holds the handle part 234 and the handle 11 for manipulating the nail gun structure of the present invention stably.

Figure 7:
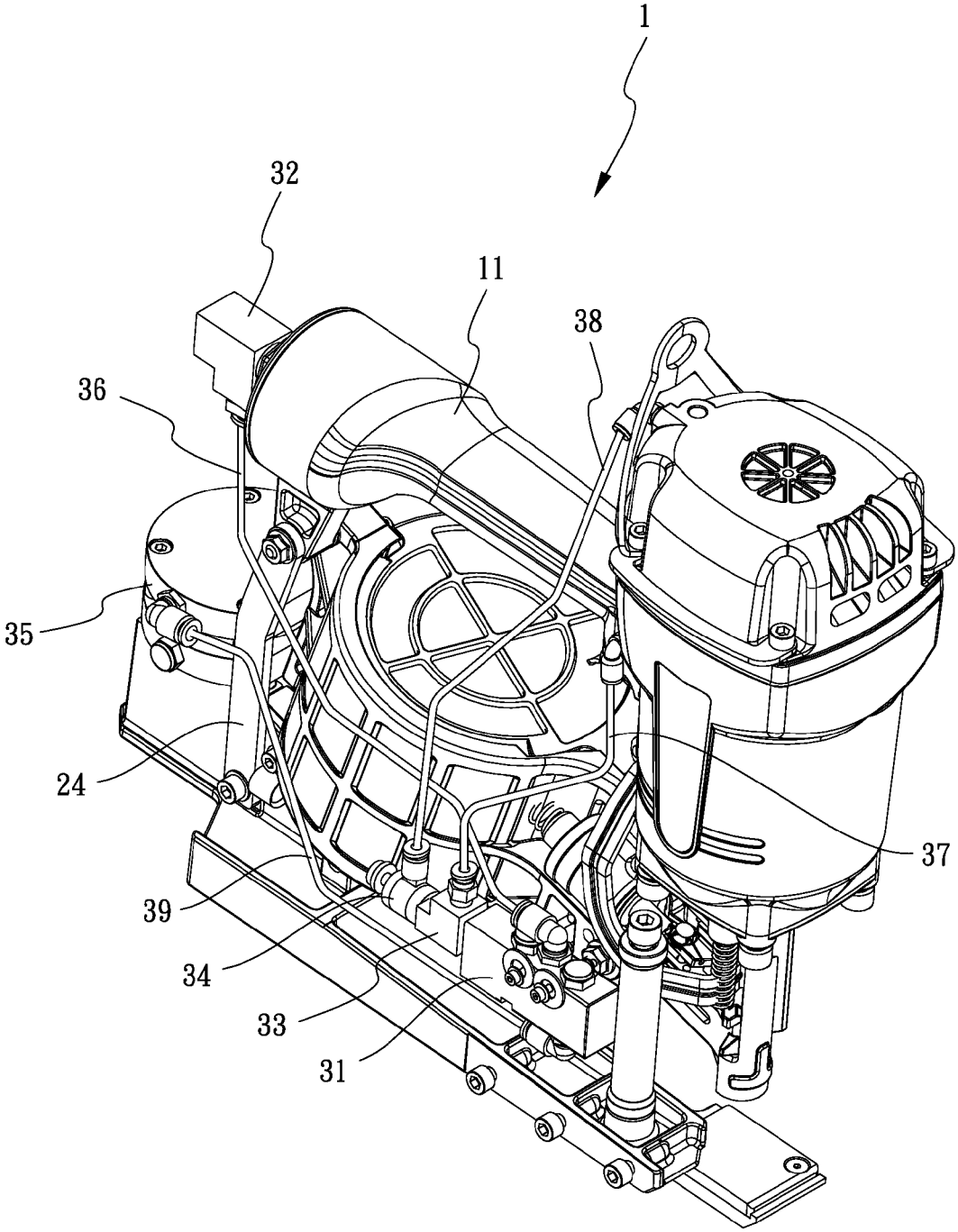
FIG. 7 is another perspective view of the present invention.
Figure 8:
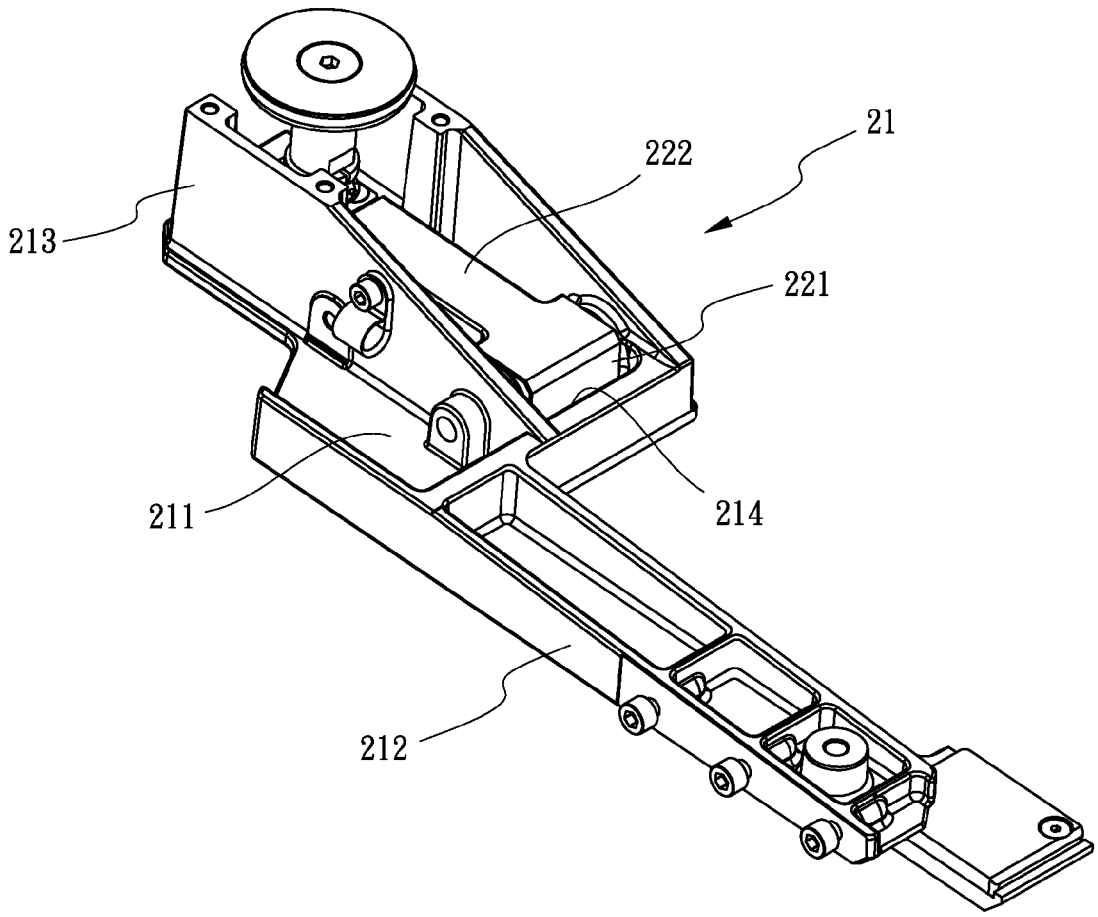
FIG. 8 is a perspective view for showing a clamp base of a clamp set is assembled with a driven base of the clamp set.
Figure 9:
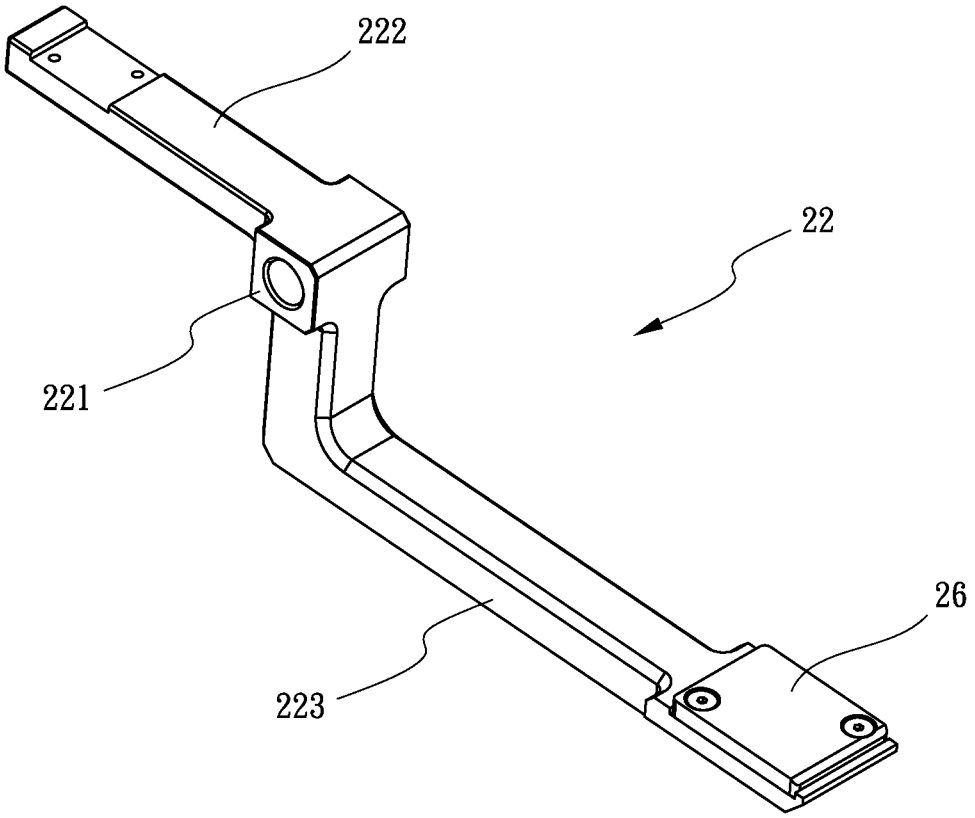
FIG. 9 is a perspective view of the clamp base of the present invention.
Figure 10:
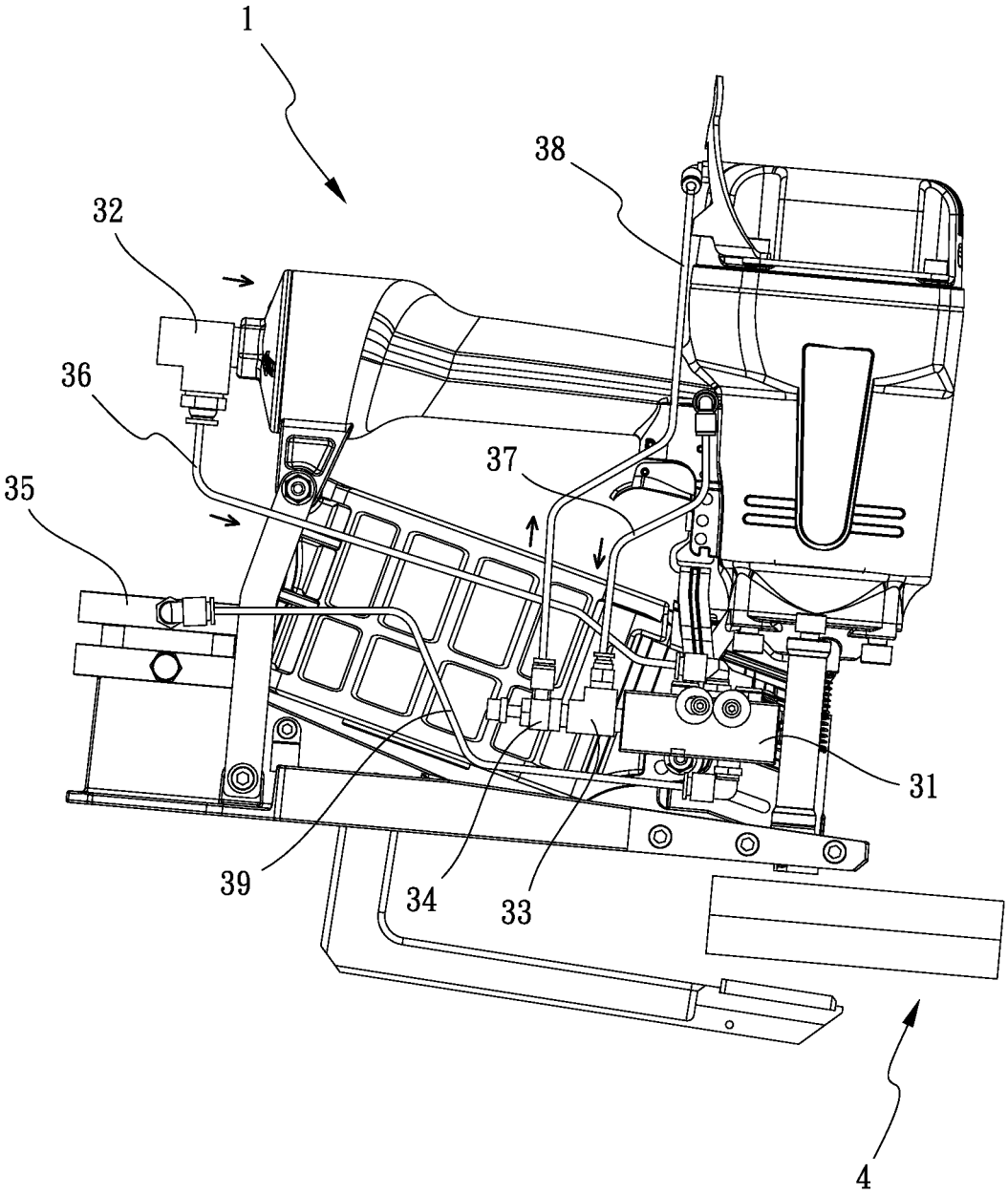
FIGS. 10-12 are side views for showing a pneumatic driving set drives the clamp base of the clamp set to nail the stacked boards.
Figure 11:
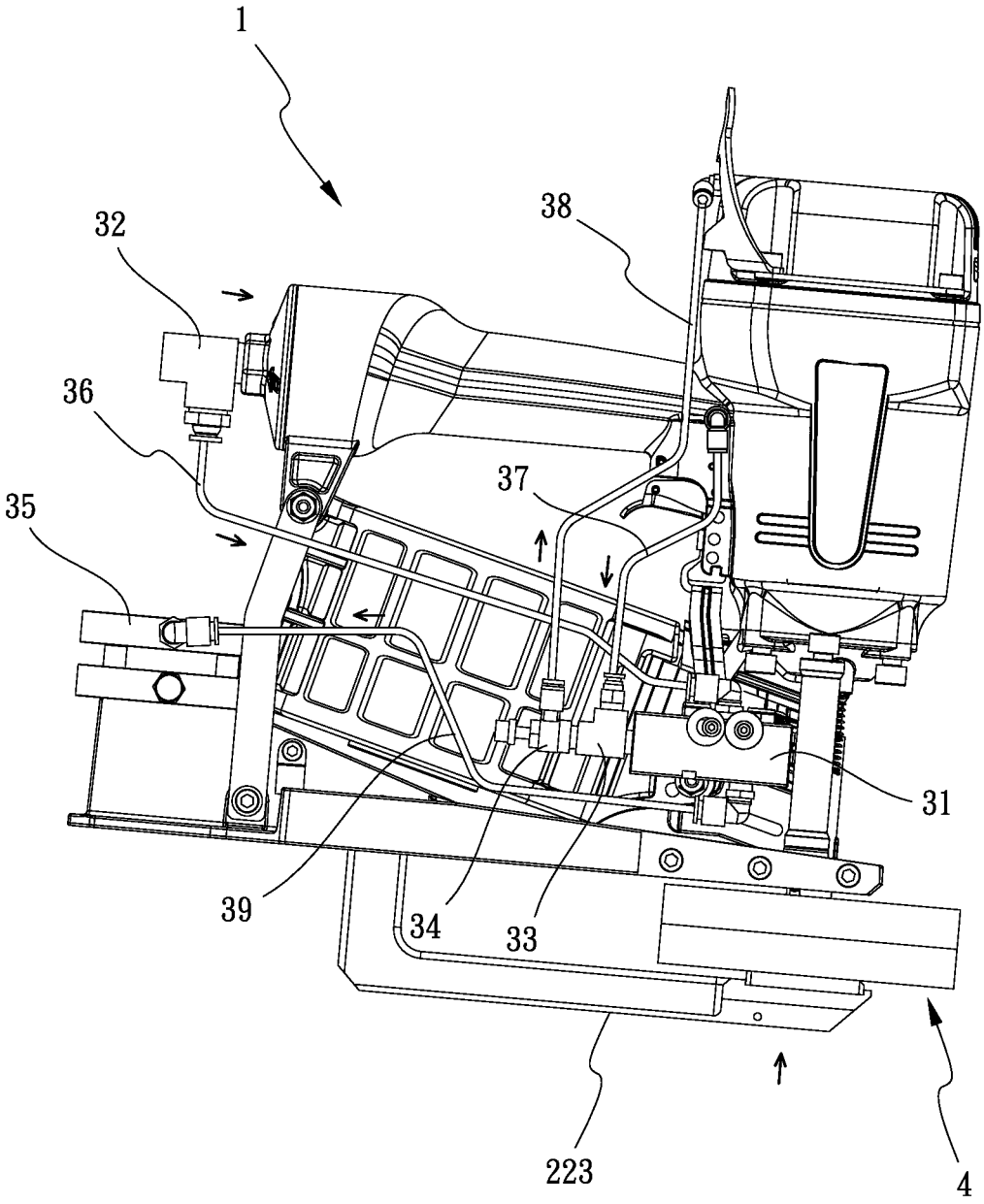
Figure 12:
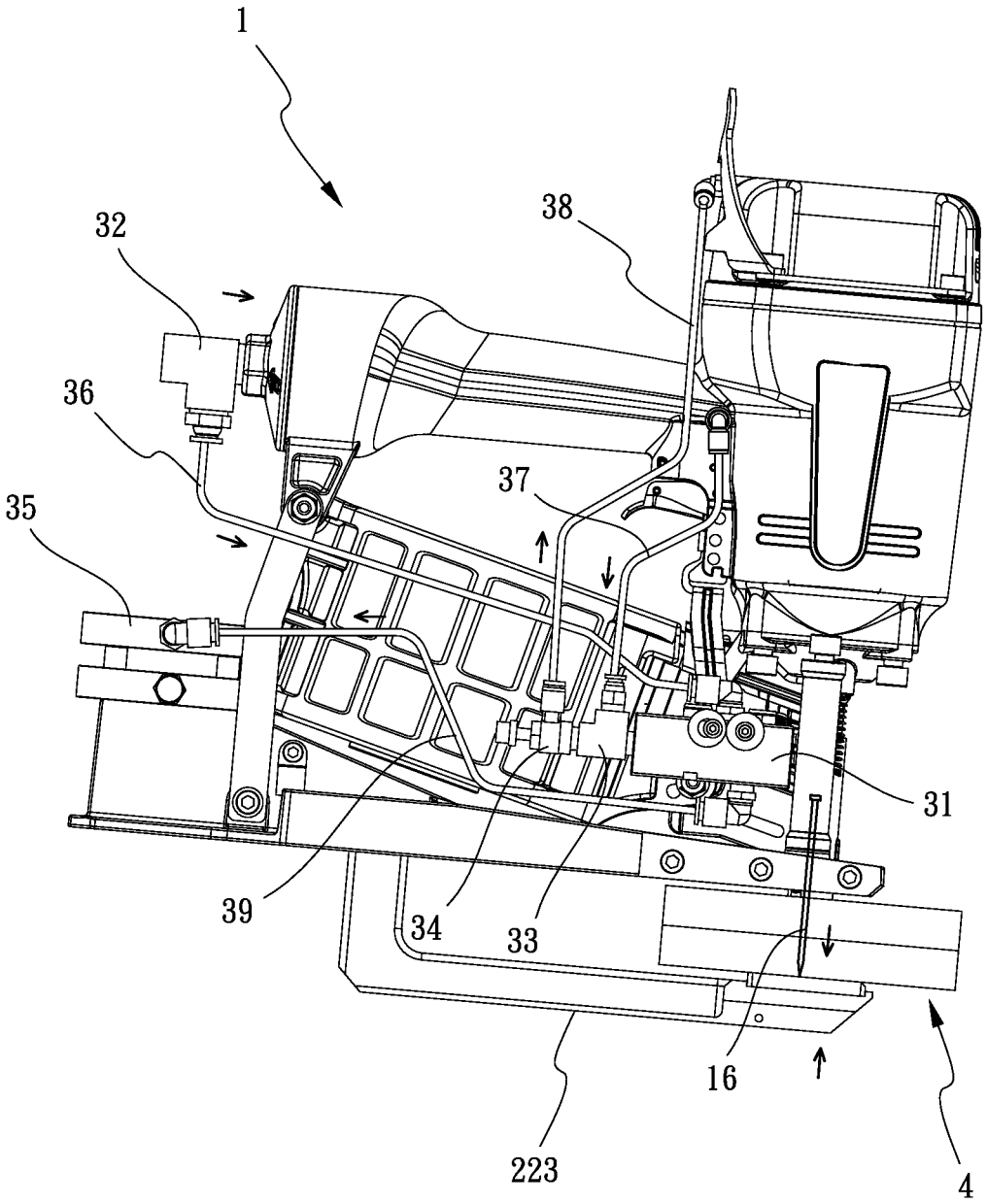

Referring to FIGS. 7-9, the pneumatic driving set 3 further has a pneumatic valve 31, a first connecting valve 32, a second connecting valve 33, an adjusting valve 34 and a driving valve 35. The pneumatic valve 31 is disposed on the fixed plate 23. The first connecting valve 32 is defined between the gun body 1 and the air pressure source. The first connecting valve 32 communicates with the gun body 1 and the air pressure source. The first connecting valve 32 communicates with the pneumatic valve 31 via a first air tube 36. The second connecting valve 33 is defined between the pneumatic valve 31 and the adjusting valve 34. The second connecting valve 33 communicates with the gun body 1 via a second air tube 37. The adjusting valve 34 communicates with the gun body 1 via a third air tube 38. The driving valve 35 is disposed on the driven base 21. The driving valve 35 communicates with the pneumatic valve 31 via a fourth air tube 39. Under this arrangement, the driving valve 35 drives the clamp base 22 pivoting relative to the driven base 21.

In addition, the driven base 21 further has a receiving part 211 and a first clamp segment 212 which is connected to the receiving part 211. The receiving part 211 has two plate parts 213 and an opening part 214 defined thereon. A distance is defined between the two plate parts 213. The opening part 214 is opened between the two plate parts 213. The clamp base 22 further has a pivoting segment 221 pivotally assembled in the opening part 214 of the driven base 21. A driven segment 222 is disposed on one end of the pivoting segment 221. A second clamp segment 223 is disposed on another end of the pivoting segment 22. The second clamp segment 223 is L-shaped. An angle is defined between the driven segment 222 and the second clamp segment 223. The driven segment 222 is assembled with the driving valve 35 and received in the receiving part 211. The driving valve 35 is used to drive the driven segment 222. The second clamp segment 223 is extended toward the gun head 13 and parallel to the first clamp segment 212. Furthermore, a spring 25 is received between the driven segment 222 and the receiving part 211. A strike plate 26 is disposed on the second clamp segment 223. The strike plate 26 corresponds to the outlet of the gun head 13 for shooting the nail 16. A secure set 5 is assembled to the gun head 13 of the gun body 1. The secure set 5 is used to secure the trigger 17, so that the trigger 17 is secured by the secure set 5 for storage.

Referring to FIGS. 3-6 and 10-12, the operation of the present invention is described as followed. When the user pulls the trigger 17 to shoot the nail 16 for fixing the stacked board 4, the gun body 1 transports the compressed air to the second connecting valve 33 via the second air tube 37 firstly; then, one part of the compressed air flows to the adjusting valve 34, and another part of the compressed air flows to the pneumatic valve 31 so as to move the components (not shown) inside the pneumatic valve 31; therefore, the first connecting valve 32 communicates with the pneumatic valve 31; subsequently, the compressed air continues to flow from the air pressure source to the first connecting valve 32, and flow through the first air tube 36 and the fourth air tube 39 so as to actuate the driving valve 35 to drive the clamp base 22 pivoting relative to the driven base 21 (namely, the driving valve 35 moves the driven segment 222 so as to make the clamp base 22 pivot relative to the opening part 214 because of the pivoting segment 221, and the second clamp segment 223 moves toward the first clamp segment 212; therefore, a top side and a bottom side of the stacked board 4 are clamped by the first clamp segment 212 and the second clamp segment 223 respectively); thereafter, when a pressure inside the adjusting valve 34 achieves a threshold pressure, the compressed air flows to the air chamber 14 via the third air tube 38 so as to push a driving rod 15 to shoot the nail 16 toward the gun head 13, and the nail 16 is shot from the gun head 13 and inserted into the stacked board 4; when a tip of the nail 16 hits the strike plate 26, the tip of the nail 16 is bent, so that the nail 16 is formed as hook shaped so as to fix the boards together securely; lastly, when the trigger 17 is released by the user, the compressed air stops flowing into the second connecting valve 33 via the second air tube 37, so that the components inside the pneumatic valve 31 are moved back for preventing the compressed air from flowing from the first connecting valve 32 to the pneumatic valve 31 via the first air tube 36; also, the compressed air stops filling up the driving valve 35; thereby, the driven segment 222 is pushed by the spring 25 so as to make the clamp base 22 pivotally move away from the driven base 21 (namely, the second clamp segment 223 pivotally moves away from the first clamp segment 212), so that the stacked board 4 fixed by the nail 16 is detachable from the present invention.

All in all, the stacked board 4 is positioned and aligned before fixing with the nail 16 via the clamp set 2 and the pneumatic driving set 3 of the present invention. Therefore, the present invention allows the user to fix the stacked board 4 with the nail 16 in an easy and fast manner.

Although the invention has been explained in relation to its preferred embodiment, it is to be understood that many other possible modifications and variations can be made without departing from the spirit and scope of the invention as hereinafter claimed.

What is claimed is:

1. A nail gun structure comprising a gun body, a clamp set and a pneumatic driving set;

the clamp set assembled with the gun body, the clamp set having a driven base and a clamp base defined thereon, the clamp base pivoting relative to the driven base so as to move toward or away from the driven base, at least two boards stacked and aligned to form a stacked board, the stacked board positioned on the clamp base and clamped between the clamp base and the driven base when the clamp base pivots relative to the driven base, the stacked board corresponding to an outlet of the gun head for shooting the nail; and the pneumatic driving set disposed between the gun body and the clamp set, the pneumatic driving set communicating with an air pressure source, the pneumatic driving set moved along with a trigger of the gun body;

wherein when a user pulls the trigger, the pneumatic driving set is moved simultaneously so as to push the clamp base pivoting relative to the driven base, so that the stacked board is positioned and clamped between the clamp base and the driven base; and then, the nail is shot from the gun head and nailed on the stacked board; lastly, the clamp base pivotally moves away from the driven base when the trigger is released by the user; and wherein the clamp set further has a fixed plate and a connecting rod; the fixed plate has a first assembling part and a second assembling part; the first assembling part is assembled on the gun body; one end of the second assembling part is connected to one end of the first assembling part; one angle is defined between the first assembling part and the second assembling part; another end of the second assembling part is disposed on one end of the driven base; one end of the connecting rod is assembled with one end of the handle; and another end of the connecting rod is assembled with another end of the driven base.

2. The nail gun structure as claimed in claim 1, wherein the clamp set further has an extension part; one end of the extension part is connected to another end of the first assembling part; another angle in defined between the extension part and the first assembling part; and a handle part is disposed on the extension part.

3. The nail gun structure as claimed in claim 1, wherein the pneumatic driving set further has a pneumatic valve, a first connecting valve, a second connecting valve, an adjusting valve and a driving valve; the pneumatic valve is disposed on the fixed plate; the first connecting valve is defined between the gun body and the air pressure source; the first connecting valve communicates with the gun body and the air pressure source; the first connecting valve communicates with the pneumatic valve via a first air tube; the second connecting valve is defined between the pneumatic valve and the adjusting valve; the second connecting valve communicates with the gun body via a second air tube; the adjusting valve communicates with the gun body via a third air tube; the driving valve is disposed on the driven base; the driving valve communicates with the pneumatic valve via a fourth air tube, so that the driving valve drives the clamp base pivoting relative to the driven base.

4. The nail gun structure as claimed in claim 3, wherein the driven base further has a receiving part and a first clamp segment which is connected to the receiving part; the receiving part has two plate parts and an opening part defined thereon; a distance is defined between the two plate parts; the opening part is opened between the two plate parts; the clamp base further has a pivoting segment pivotally assembled in the opening part of the driven base; a driven segment is disposed on one end of the pivoting segment; a second clamp segment is disposed on another end of the pivoting segment; an angle is defined between the driven segment and the second clamp segment; the driven segment is assembled with the driving valve and received in the receiving part; the driving valve is used to drive the driven segment; the second clamp segment is extended toward the gun head and parallel to the first clamp segment.

5. The nail gun structure as claimed in claim 4, wherein a spring is received between the driven segment and the receiving part.

6. The nail gun structure as claimed in claim 4, wherein a strike plate is disposed on the second clamp segment; the strike plate corresponds to the outlet of the gun head for shooting the nail.

7. The nail gun structure as claimed in claim 1, wherein a secure set is assembled to the gun head so as to so secure the trigger.

* * * * *